US005531591A

United States Patent [19]

Yamazaki

[11] Patent Number: 5,531,591

[45] Date of Patent: Jul. 2, 1996

[54] SAFETY DEVICE FOR USE IN LIGHTER

[75] Inventor: Nobuo Yamazaki, Shizuoka-ken, Japan

[73] Assignee: Tokai Corporation, Shizuoka-ken, Japan

[21] Appl. No.: 406,363

[22] Filed: Mar. 17, 1995

[51] Int. Cl.[6] ..... F23D 11/36

[52] U.S. Cl. ..... 431/153; 431/255; 431/142; 431/129

[58] Field of Search ..... 431/255, 129, 431/277, 153, 142, 144, 344

[56] References Cited

U.S. PATENT DOCUMENTS 5,120,215 6/1992 Amoros Nollas .

FOREIGN PATENT DOCUMENTS 3-25215 2/1991 Japan .

*Primary Examiner*—Larry Jones

*Attorney, Agent, or Firm*—Brumbaugh, Graves Donohue & Raymond

[57] ABSTRACT

A safety device for use in a gas lighter. An actuating member provided on top of a lighter body is supported in a pivotal fashion by a leg downwardly extending therefrom. The leg is also provided with a lock member. A circular-arc-shaped guide groove and a recessed groove at the center-side end of the guide groove are formed along the upper end of one of the tank side surfaces. The lock member has a base portion which travels along a regulation groove (24) in a restricted manner, a stopper which is connected to an upper part of the base portion and is engageable with the recessed groove, a finger grip which permits a lock release operation and causes the stopper fitted into the recessed groove to be engaged with the guide groove, and a spring member for urging the base portion toward the center of the lighter body and holding the lock member in a locked position and an unlocked position. These elements of the lock member are formed into one assembly. Fitting of the stopper into the recessed groove deters the pivotal movement of the actuating member. Disengagement of the stopper from the recessed groove permits pivotal movement of the actuating member, and the lock member is displaced to a lockable position upon coming into contact with the end face of the guide groove. The spring member is in a coiled shape, but may be formed into a U-shaped, V-shaped, or bow-shaped pattern.

2 Claims, 7 Drawing Sheets

SAFETY DEVICE FOR USE IN LIGHTER

BACKGROUND OF THE INVENTION

1. Field of the Invention

This invention relates to a safety device for use in a gas lighter, and more particularly to a safety device which prevents inadvertent ignition by children by rendering an actuating member inoperative when a gas lighter is not in use.

2. Description of Prior Art

A gas lighter is a convenient tool which can easily be fired by actuation of an actuating member, but inadvertent ignition of the lighter is a safety hazard for those who, like children, are unfamiliar with appropriate use of the lighter.

For this reason, there is a demand for a safer gas lighter which can prevent inadvertent ignition by those who, like children, are unfamiliar with the operation thereof. Previously, gas lighters with various types of safety devices have already been put forward. Most of these safety devices are provided with a lock mechanism which hinders depression of an actuating member without the release of the lock mechanism. However, all of these gas lighters have drawbacks in their usage, and thus it is desirable that the gas lighter be improved for practical use.

For example, Japanese Unexamined Patent Publication No. HEI-3(1991)-25215 discloses a safety device for use in a gas lighter, and the safety device is provided with a lock member to hinder depression of an actuating member for ignition operation. After the gas lighter has been ignited by displacing the lock member to an unlocked position, the lock member automatically returns to its original locked position.

However, the actuating member for the ignition operation of the above-mentioned safety device is designed so that it can be applied to a gas lighter which requires a vertical depression operation. Moreover, a lock mechanism of this safety device is to stop the action of the actuating member only in a vertical direction. It is impossible to apply this mechanism directly to a gas lighter which involves ignition by pivotal movement of the actuating member.

In addition, in the case of the gas lighter involving the pivotal movement of the actuating member, the actuating member projects out of a lighter body, which makes it difficult to provide a safety mechanism under a lower part of the actuating member or closer to a side of the lighter body.

SUMMARY OF THE INVENTION

In view of the above mentioned drawbacks in the art, the object of the present invention is to apply the safety device set forth above to a gas lighter which involves pivotal movement of an actuating member by a slide operation, and to provide a safety device for use in a gas lighter having superior operability and reliability and an auto-return function for automatically making a lock mechanism active without a re-locking operation after the use of the lighter by release of the lock mechanism.

To achieve these objects, according to one aspect of the present invention, there is provided a safety device for use in a gas lighter comprising:

a) an actuating member which covers the upper end of a lighter body in a cap-like manner, the actuating member having a leg rotatably attached to the lighter body by means of a rotation axis projecting from the leg, and a regulation groove formed in the leg;

b) a tank side surface, one of two wider surfaces of the lighter body, having a circular-arc-shaped guide groove formed at the upper end of the tank side surface and an end recessed groove formed at one end of the circular-arc-shaped guide groove in the vicinity of the center of the upper end of the tank side surface; and c) a lock member made up by integration of a base portion which travels in a regulated manner by means of the regulation groove, a stopper portion which is joined to the upper end of the base portion and is engageable with the guide groove and the end recessed groove, a finger grip portion which permits a lock release operation and is connected to the stopper portion in such a way as to be kept a certain distance apart from the stopper portion toward the outside, the finger grip portion displacing the stopper portion from a locked position, where the stopper portion engages with the end recessed groove, to an unlocked position, where the stopper portion engages with the guide groove, along the regulation groove, and a spring member for forcefully urging the base portion toward the center of the lighter body and holding the same attracted at the locked position and the unlocked position, whereby the stopper portion engages with the end recessed groove to prevent pivotal movement of the actuating member when thelock member is situated at the locked position, and the actuating member becomes pivotable when the lock member is displaced to the unlocked position, and also the lock member is displaced to the locked position to the other end of the guide groove as a result of pivotal movement of the actuating member.

In a preferred embodiment of the present invention, the spring member of said lock member is preferably made up of a coiled spring with one end thereof being linked to the base portion and the other end thereof being fitted to the leg of the actuating member in a curved and deformed fashion.

According to the safety device for use in a gas lighter, in the locked position where the stopper portion of the lock member is engagedly fitted into the end recessed groove formed at one end of the guide groove in the vicinity of the center of the upper end of the side surface, the engagement of the stopper portion with the recessed groove prevents pivotal movement of the actuating member, thereby rendering the gas lighter inoperative. In the inoperative state, the spring member holds the stopper portion engaged in the recessed groove, whereby the gas lighter is kept in an inoperative condition.

When the finger grip of the lock member is displaced from the locked position to the unlocked position along the regulation groove, the stopper portion is disengaged from the end recessed groove, and it is displaced to the circular-arc-shaped guide groove. This renders the actuating member pivotable, which in turn makes the gas lighter operative. In this state, when the actuating member is moved in a pivotal manner, fuel is discharged from a fuel supply means together with the pivotal movement of the actuating member, and the gas is ignited by means of an ignition means.

The lock member is also displaced in conjunction with the pivotal movement of the actuating member in an integrated fashion. Once the stopper portion of the lock member reaches to the other end of the guide groove, the stopper portion comes into contact with that other end of the guide groove and then returns to a lockable position in the direction opposite to the movement of the actuating member. Upon release of a finger from the actuating member, the actuating member returns to its original position. The stopper portion of the lock member is moved to the position, where it is engaged with the end recessed groove, under an elastic restoring force of the spring member. In this way, the gas lighter is automatically restored to the inoperative state where the actuating member is prohibited from moving in a pivotal manner, thereby preventing inadvertent ignition of the gas lighter.

DETAILED DESCRIPTION OF THE PREFERRED EMBODIMENT

Referring now to the accompanying drawings, a preferred embodiment of the present invention will be described in detail hereinbelow.

Figure 1:
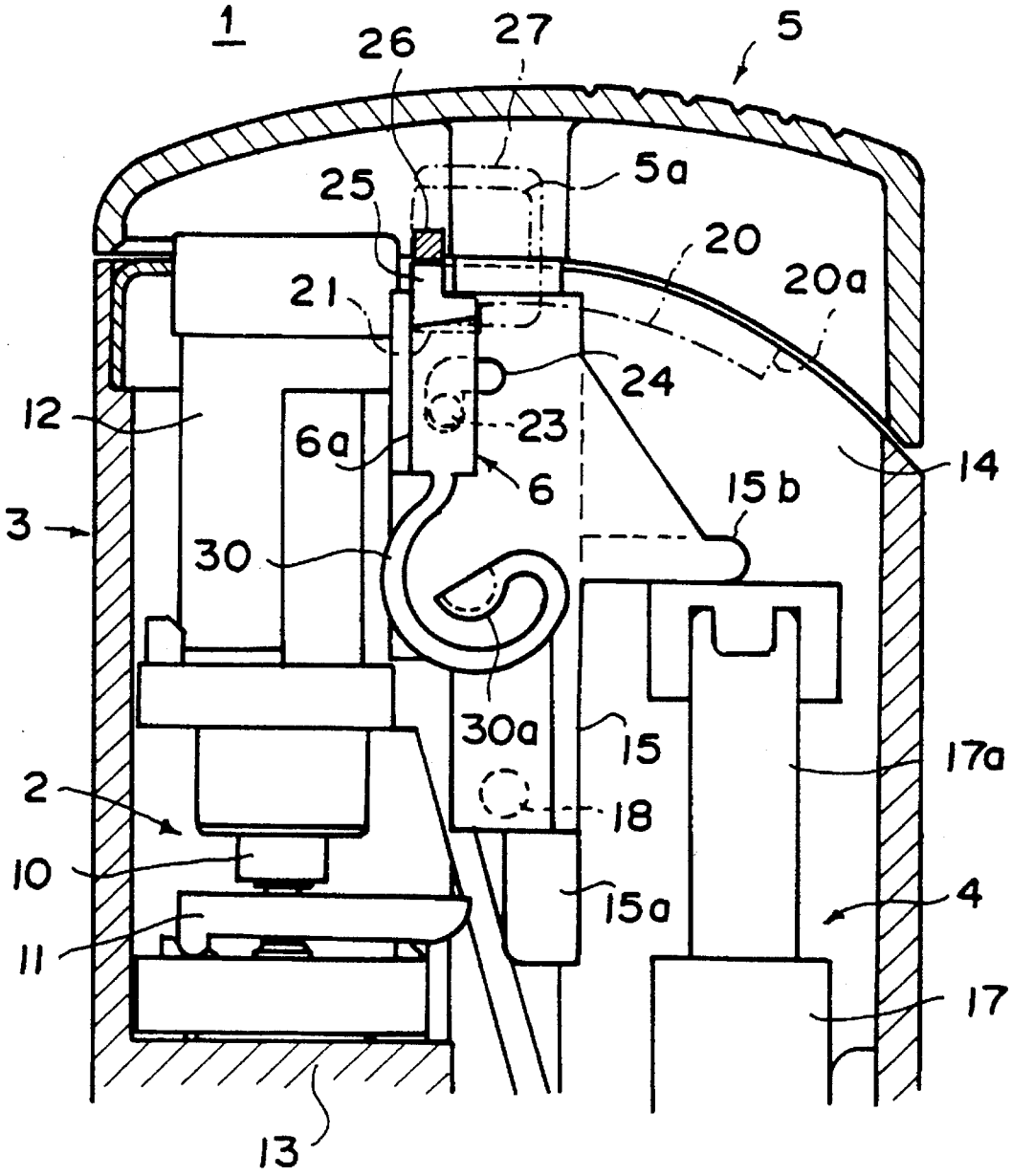
FIG. 1 is a cross-sectional front view showing principle elements of a gas lighter equipped with a safety device in one embodiment according to the present invention.
Figure 2:
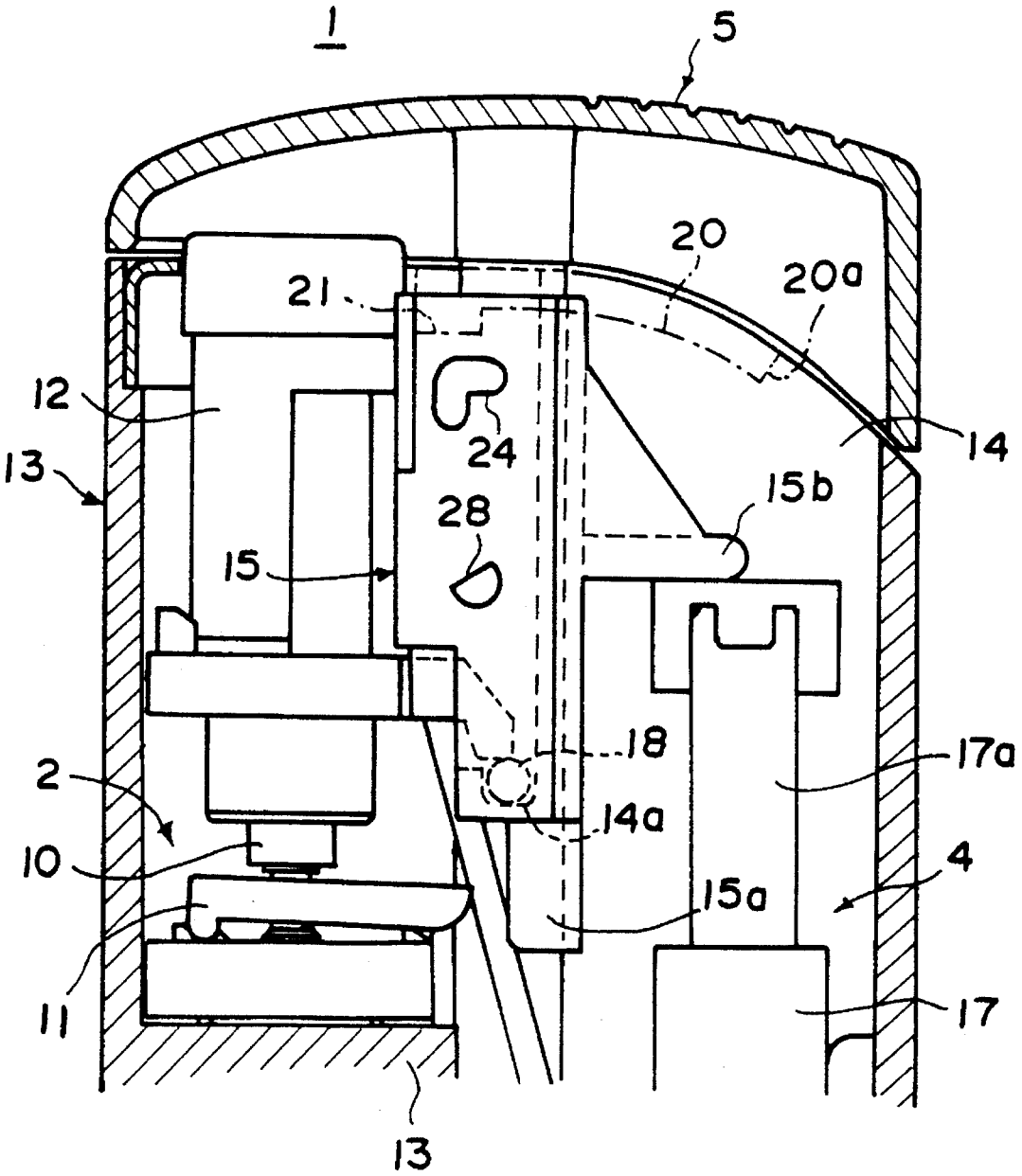
FIG. 2 is a cross-sectional front view of the same principle elements shown in FIG. 1 illustrating the gas lighter when a lock member is taken off from the lighter.
Figure 3:
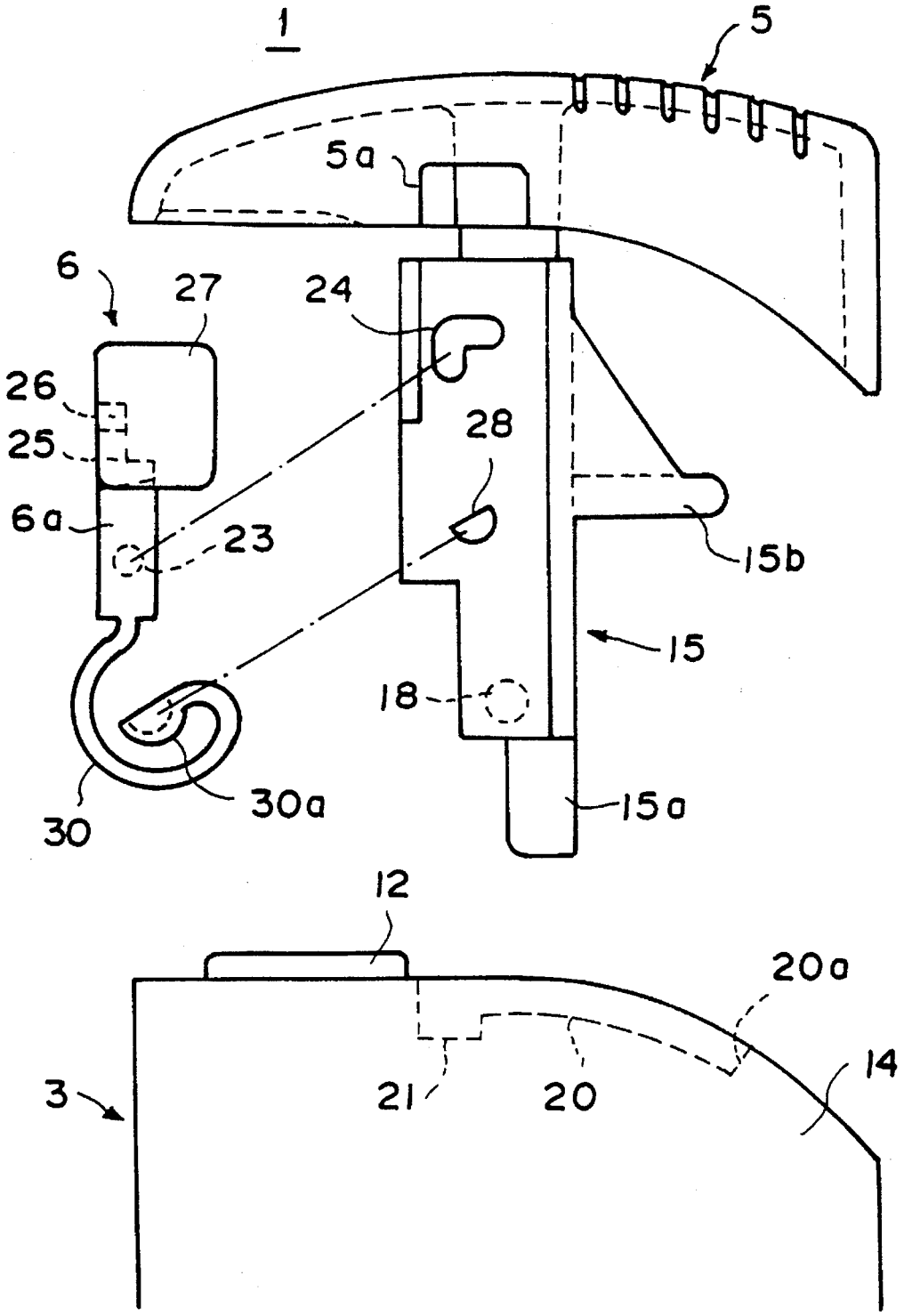
FIG. 3 is a front view showing principle elements when they are disassembled.

FIG. 1 shows a cross section of the structure of principle elements of a gas lighter equipped with a safety device in one embodiment according to the present invention. FIG. 2 shows the cross section of the structure of the same elements when a lock member is taken off from the safety device, and FIG. 3 is a front view of the structure showing the elements in a disassembled state.

A gas lighter 1 is provided with a fuel supply means 2 having a nozzle 10 for upwardly discharging fuel gas; a lighter body 3 for storing fuel gas; an ignition means 4 for igniting the fuel gas; an actuating member 5 for actuating the fuel supply means 2 and the ignition means 4; and a lock member 6 for controlling pivotal movement of the actuating member 5.

The lighter body 3 is made up of a tank body 13 made of synthetic resin for storing fuel gas, such as butane gas, inside thereof, and tank side surfaces 14 constituting a surrounding wall of the gas lighter 1. The known fuel supply means 2 is provided on the upper end of the tank body 13 for controlling the quantity of fuel gas to be discharged. A lever 11 is substantially horizontally disposed to open and close discharge of gas from the nozzle 10 attached to the fuel supply means 2. The lever 11 has a fulcrum on one end thereof and is designed to cause gas to be discharged when the other end of the lever 11 is raised. Moreover, a combustion cylinder 12 is provided above the nozzle 10 so as to surround it.

The ignition means 4 is constituted of a piezoelectric unit 17 vertically oriented parallel to the fuel supply means 2. An actuating rod 17*a* of the piezoelectric unit 17 is upwardly forced by means of a spring (not shown). When the actuating rod 17*a* is pressed downwards, a high voltage for electric discharge is applied to electrodes of the combustion cylinder 12, so that electrical discharge develops. As a result of this fuel gas discharged from the nozzle 10 is ignited.

The actuating member 5 covers the upper ends of the surrounding wall of the lighter body 3, that is, the tank side surfaces 14 in a cap-like manner. The lower side of the actuating member 5 has a circular-arc shape which increases in curvature and extends further downward from the center toward one lateral end of the actuating member 5. The upper edges of the tank side surfaces 14, corresponding to the lower side of the actuating member 5, are also formed into a circular-arc shape. A leg 15 extends downwards from the center of the actuating member 5, and a pivot 18 is formed at right angles to the lower end of the leg 15. The pivot 18 is supported in a pivotal manner by a bearing 14*a* (see FIG. 2) formed in one of the tank side surfaces 14, and the actuating member 5 rotates around the pivot 18 in a pivotal manner. An engaging leaf 15*a* projects from the lower end of the leg 15, and it raises the other end of the lever 11 upon meshing with the other end of the lever 11 in response to the pivotal movement of the actuating member 5. A pressing portion 15*b* projects from the center of the leg 15 toward the actuating rod 17*a* in such a way that it comes into contact with the upper end of the actuating rod 17*a* of the piezoelectric unit 17. Upon receipt of an upthrusting force of the actuating rod 17*a* via the pressing portion 15*b*, the actuating member 5 is forced to move in a pivotal manner in a returning direction.

A circular-arc-shaped guide groove 20 is formed along an upper inner surface of one tank side surface 14 of the lighter body 3, and an end recessed groove 21 is formed, so as to be downwardly bent, at the end of the guide groove 20 in the vicinity of the center of the guide groove 20.

The lock member 6 for stopping pivotal movement (slide movement) of the actuating member 5 is also made of synthetic resin. The lock member 6 is interposed between the leg 15 of the actuating member 5 and the side surface 14 of the lighter body 3. A pin 23 projects from an inner surface of a base portion 6*a* of the lock member 6 which longitudinally extends along the side surface of the leg 15, and this pin 23 engages with a regulation groove 24 formed in the side surface of the leg 15. The regulation groove 24 regulates the movement of the pin 23 so as to permit vertical movement from a locked position and horizontal movement from the upper end of the vertical path, i.e., movement along a substantially L-shaped path.

A stopper portion 25 to be inserted into the guide groove 20 of the lighter body 3 is connected to top of the base portion 6*a* in such a way as to project at right angles to the tank side surface 14. The stopper portion 25, fitted into the end recessed groove 21 at the end of the guide groove 20 in the locked position, slidably travels along the circular-arc-shaped guide groove 20. In addition, a connecting portion 26 extends from an upper part of the stopper portion 25 so as to project beyond the outer surface of the actuating member 5 (or the tank side surface 14) to the outside. A finger grip 27 for lock release is attached to the outermost end of the connecting portion 26, and it travels along the outer surface of the actuating member 5. The connecting portion 26 passes through a rectangular cutout opening 5*a* formed in the side surface of the actuating member 5, and the cutout opening 5*a* has a size which allows the connecting portion 26 to move in conjunction with the movement of the base portion 6a along the regulation groove 24.

One end of a spring member 30 made of a coiled spring is connected to the lower end of the base portion 6a of the lock member 6, and a supporting point 30a, serving as a fixed point, is formed on the other end of the spring member 30. A broken circular portion projecting from the side surface of the supporting point 30a is fitted into a broken circular supporting aperture 28 (see FIG. 2) formed in the side surface of the leg 15, whereby the supporting portion 30a is fixedly supported. The spring member 30 has a linear shape in a free state. When this spring member 30 is coiled while the supporting portion 30a is fixed, an elastic restoring force develops in the spring member 30. This elastic restoring force acts on the base portion 6a so as to pull the base portion 6a downward. The spring member 30 may be formed into a U-shaped pattern, a V-shaped pattern, or a bow-shaped pattern, as well as the coiled pattern.

With reference to FIGS. 4–7, the operation of the safety device of the gas lighter 1 having the above-mentioned structure will now be described in detail.

FIG. 1 shows the gas lighter 1 in a locked state, i.e., an inoperative state. The stopper portion 25 of the lock member 6 is engagedly fitted into the end recessed groove 21 of the guide groove 20, and the engagement of the stopper portion 25 with the recessed groove 21 deters pivotal rightward movement of the actuating member 5, thereby rendering the lighter 1 inoperative. In this locked state, the stopper portion 25 is forced downwardly by means of the spring member 30, which holds the stopper portion 25 engaged with the end recessed groove 21. In this way, the gas lighter 1 is maintained in a locked state.

Figure 4:
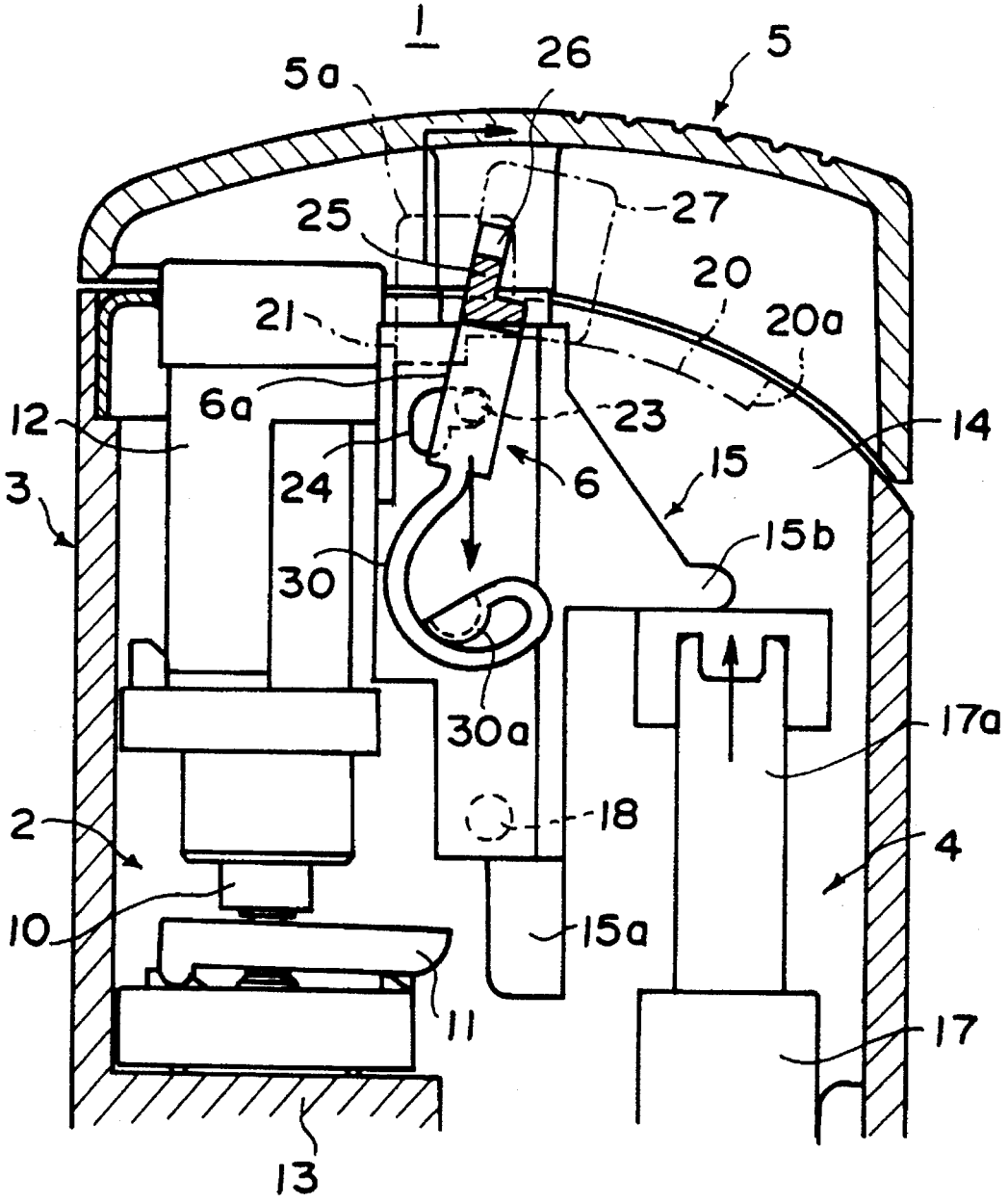
FIG. 4 is a cross-sectional front view of principle elements when the gas lighter is operative.

When the gas lighter 1 is used, the finger grip 27 of the lock member 6 is raised and moved rightwards as shown in FIG. 4. Then, the stopper portion 25 is disengaged from the end recessed groove 21 and meshes with the circular-arc-shaped guide groove 20. At this time, a force is acting on the actuating member 5 in a direction back toward the recessed groove 21, by virtue of an up-thrusting force from the actuating rod 17a of the piezoelectric unit 17. Hence, the lock release operation of the finger grip 27 of the lock member 6 is not sufficient to rotate the actuting member 5 in a pivotal manner. Moreover, the lock release operation brings about movement of the pin 23 of the base portion 6a of the lock member 6 along the regulation groove 24. Since the elastic restoring force of the spring member 30 acts only in a downward direction even in this state, the pin 23 is stopped at a lower brim of the horizontal portion of the regulation groove 24. As a result of this, the lock member 6 will not return to the locked position even when a finger is released from the finger grip 27, and hence the lock member 6 is held in the unlocked position.

Figure 5:
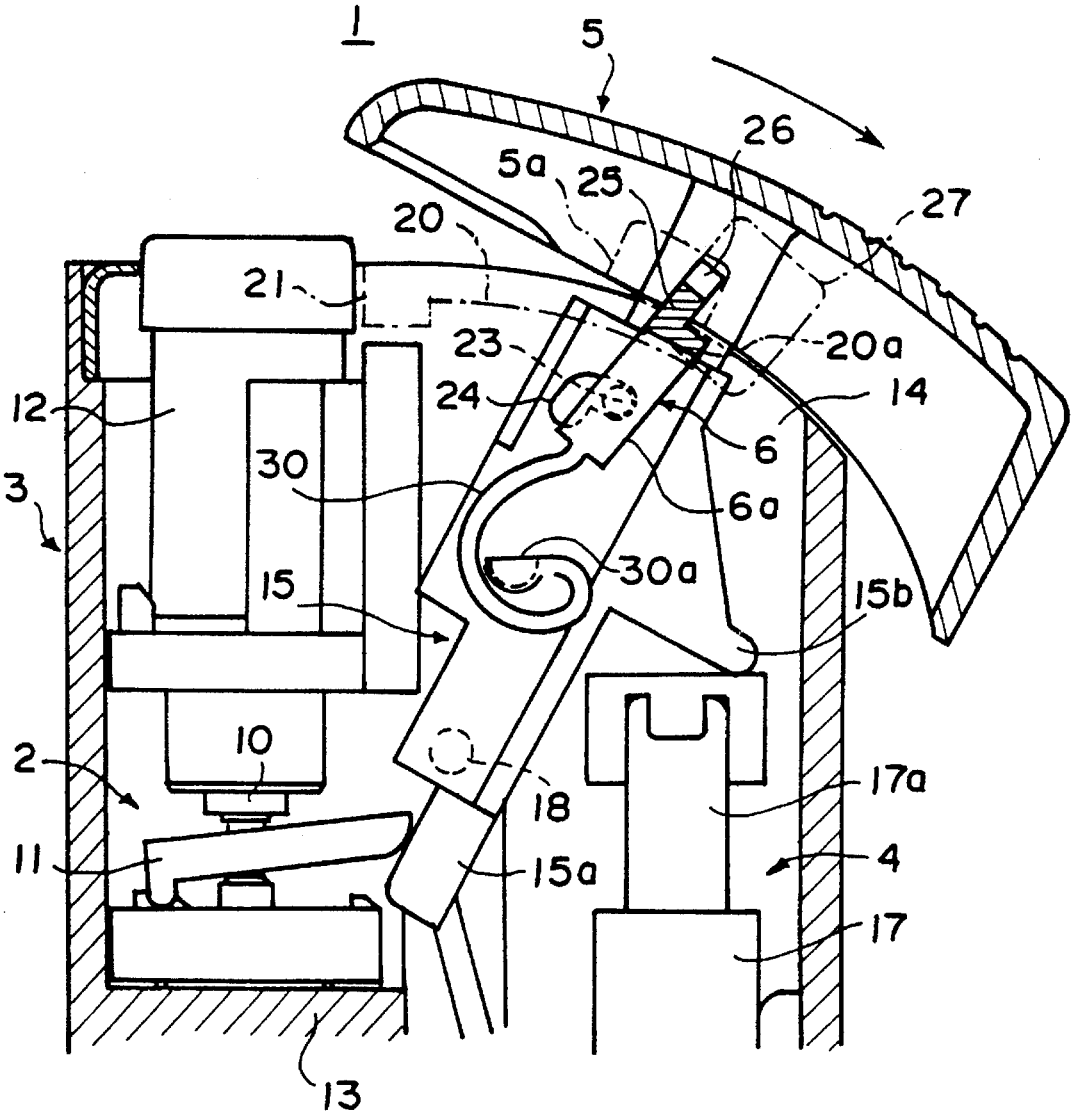
FIG. 5 is a cross-sectional front view of principle elements shown midway through the ignition action.

As shown in FIG. 5, when the actuating member 5 is rotated to the right in the drawing in a pivotal fashion, the actuating member 5 is rotated in a viotal manner around the pivot 18 of the leg 15, and the lock member 6 retained by the leg 15 is also integrally rotated in a pivotal fashion. Then, the stopper portion 25 of the lock member 6 travels to the right in the drawing along the inside of the circular-arc-shaped guide groove 20. In response to the pivotal movement of the actuating member 5, the pressing portion 15b of the leg 15 depresses the actuating rod 17a of the piezoelectric unit 17, and the engaging leaf 15a also raises the lever 11, so that gas is discharged. The thus discharged gas is then ignited by a high voltage electric discharge from the piezoelectric unit 17.

Figure 6:
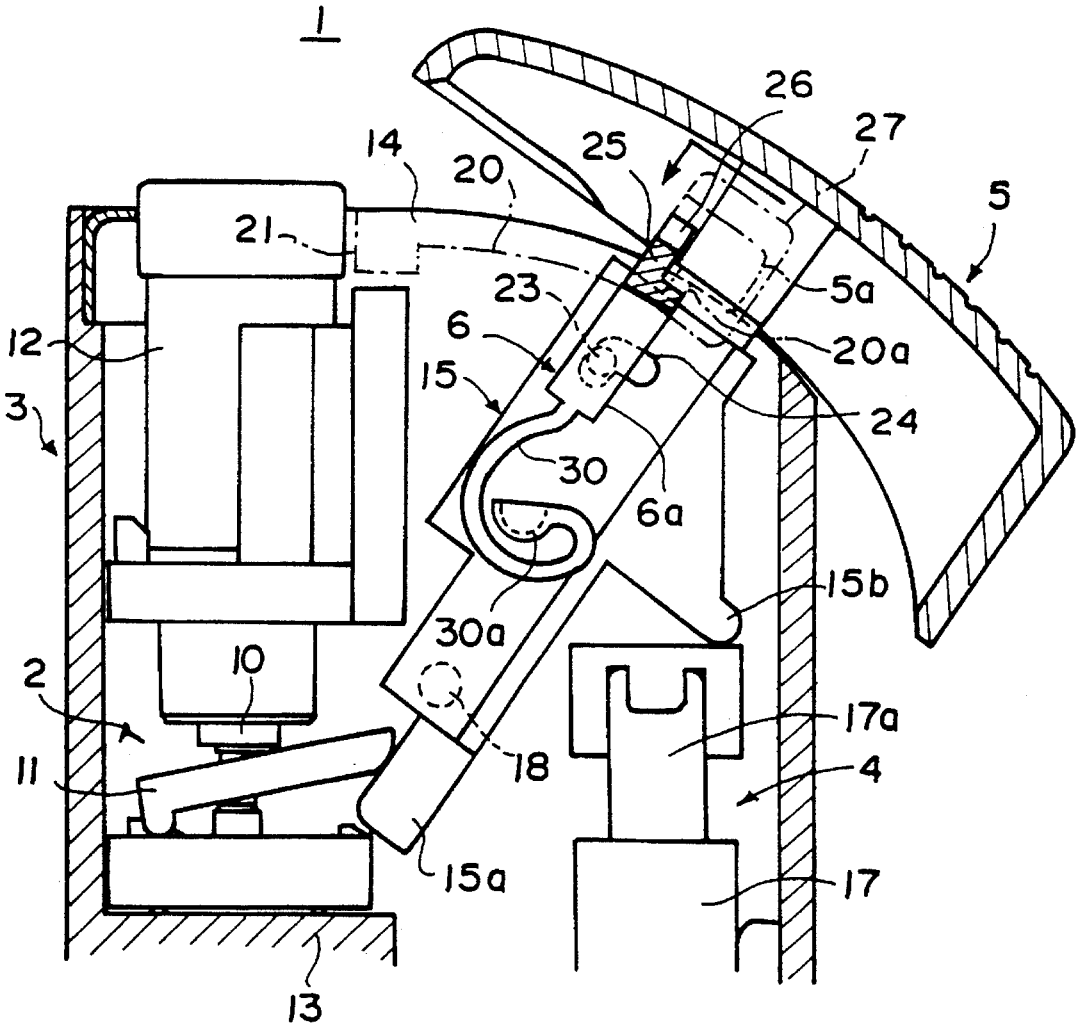
FIG. 6 is a cross-sectional front view of principle elements shown at the end of the ignition action.
Figure 7:
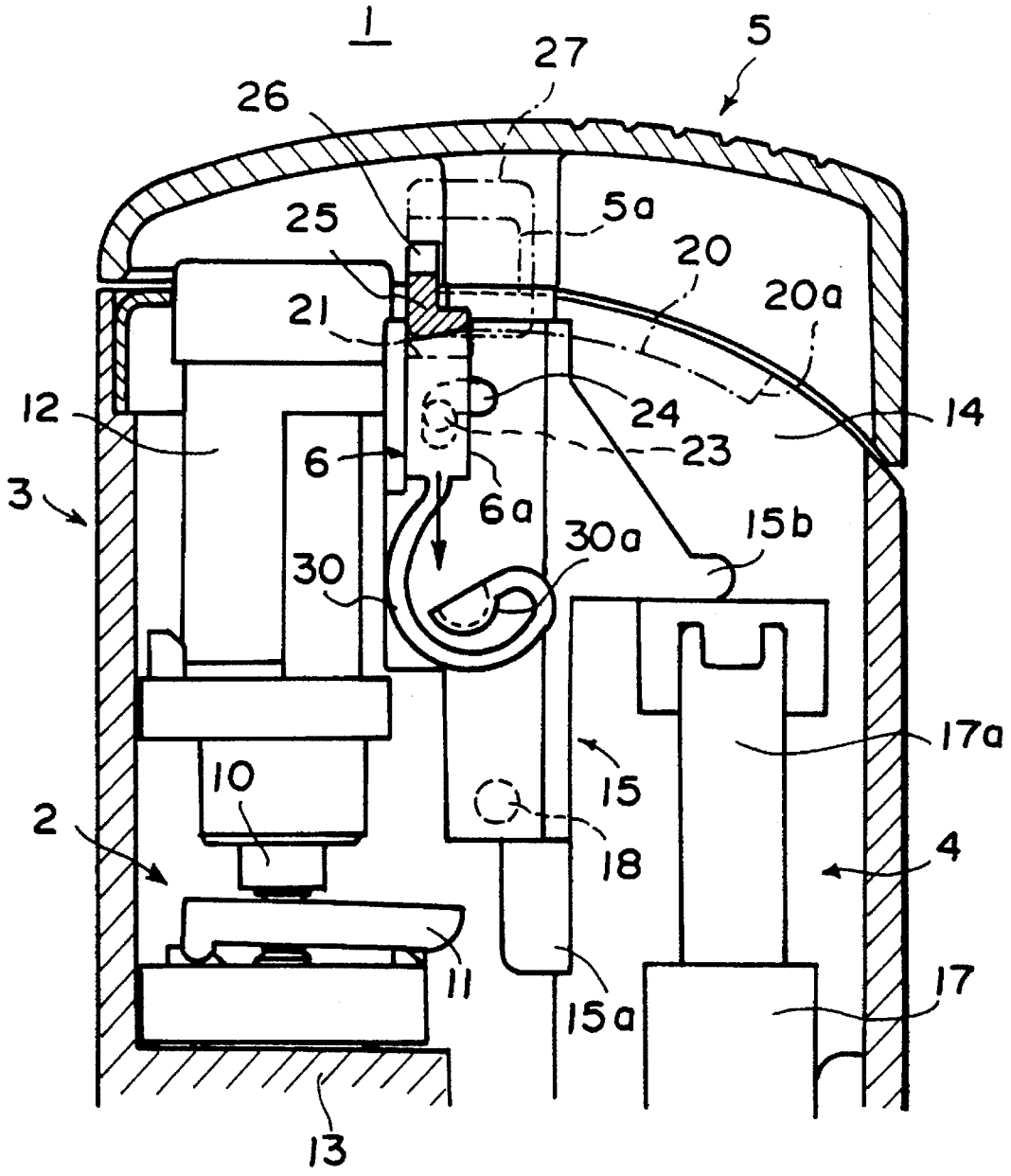
FIG. 7 is a cross-sectional front view of principle elements showing transition of the lock member to a re-locked state.

As shown in FIG. 6, further pivotal movement of the actuating member 5 toward the right brings the stopper portion 25 of the lock member 6 in contact with an outermost end face 20a of the guide groove 20, whereupon the stopper portion 25 travels in a reverse direction, i.e., to the left with respect to the actuating member 5. At the same time, the lock member 6 held in the unlocked position is released, which in turn causes the pin 23 of the base portion 6a to be displaced from the horizontal portion to the vertical portion in the regulation groove 24, thereby restricting any further movement of the actuating member 5 to the right in the drawing.

When a finger is released from the actuating member 5 after use, the actuating member 5 returns to its original position; namely, it is moved to the left in the drawing in a pivotal manner by virtue of a restoring force, acting on the actuating rod 17a of the piezoelectric unit 17 and the nozzle 10. Then, the lever 11 returns to its horizontal state, which interrupts the discharge of fuel. When the actuating member 5 returns to the lateral center position of the lighter body 3, the stopper portion 25 of the lock member 6 also travels to the center end of the guide groove 20. Upon aligning with the end recessed groove 21, the stopper portion 25 is engagedly fitted into the end recessed groove 21 under the elastic restoring force of the spring member 30. In this way, the actuating member 5 is automatically restored to its original inoperative state.

According to this embodiment, the lock member 6 travels from or to the locked position and the unlocked position with respect to the actuating member 5 while moving together with the pivotal movement of the actuating member 5 in an integrated fashion. In either position, the lock member 6 is attracted by the spring member 30, and hence it is ensured that the lock member 6 is held in the locked position and the unlocked position. It is possible to avoid accidental movement of the lock member 6 to the unlocked position resulting from a dead weight of the lighter or contact with other articles, and it is also possible to avoid the return of the lock member 6 to the locked position during ignition of the lighter, whereby a smooth ignition operation is ensured. Automatic return of the lock member 6 to the lockable position in conjunction with an ignition operation prevents the lock member 6 from being left in the unlocked position, thereby resulting in improved reliability.

Release of the lock member 6 from its locked state involves two-stage operation of the finger grip 27 in two directions. This makes it impossible for children to bring about inadvertent ignition during handling of the lighter, thereby resulting in improved safety.

No groove for the operation of the lock member 6 is formed in the tank side surface 14, and hence it is possible to prevent erroneous operation of the lighter due to dust or the like. Moreover, the finger grip 27 of the lock member 6 can be designed as one element of the gas lighter, and the lack of the groove for the lock member 6 affords increased degrees of freedom, thereby leading to an improved commodity value.

It is possible to integrate the lock member 6, the spring member 30 and the finger grip 27 into one assembly, and it is also possible to integrate the thus integrated lock member 6 and the actuating member 5 into one body at the time of assembly of the lighter 1, thereby facilitating the assembly of the lighter 1. This makes it possible to realize automatic assembly of the lighter. The attachment of the lock member 6 to the actuating member 5 only involves engagement of the pin 23 with the connecting portion 26 or fitting of the pin 23 into the connecting portion 26. This makes it possible to obtain an elastic restoring force as well as to facilitate assembly of the lighter.

According to the safety device for use in a gas lighter having the above-mentioned structure, the lock member is attached to the actuating member which is moved in a pivotal manner. The lock member is released from its locked position by traveling along the regulation groove while receiving the elastic restoring force of the spring member. An upper part of the lighter body is provided with the circular-arc-shaped guide groove, with which the stopper portion of the lock member engages, and the end recessed groove formed at the end of the guide groove for holding the stopper portion locked. This makes it possible to easily provide a pivotable actuating member with a lock mechanism, which ensures that the lock member is held in a locked state, thereby resulting in improved reliability. The lock member automatically returns to the locked position in conjunction with the pivotal movement of the actuating member after the ignition of the lighter, thereby resulting in improved safety of the lighter.

The embodiment of the invention has now been described in detail. It is to be noted, however, that the descriptions of the specific embodiment are merely illustrative of the principle underlying the inventive concept. It is contemplated that various modifications of the disclosed embodiment, as well as other embodiments of the invention will, without departing from the spirit and scope of the invention, be apparent to persons versed in the art.

What is claimed is:

1. A safety device for use in a gas lighter comprising:

a) an actuating member which covers the upper end of a lighter body like a cap, said actuating member having
  a leg rotatably attached to said lighter body by means of a rotation axis projecting from said leg, and
  a regulation groove formed in said leg;

b) a tank side surface, one of two wider surfaces of said lighter body, having
  a circular-arc-shaped guide groove formed at the upper end of said tank side surface and
  an end recessed groove formed at one end of said circular-arc-shaped guide groove in the vicinity of the center of said upper end of said tank side surface; and c) a lock member made up by integration of
  a base portion which travels in a regulated manner by means of said regulation groove,
  a stopper portion which is joined to the upper end of said base portion and is engageable with said guide groove and said end recessed groove,
  a finger grip portion which permits a lock release operation and is connected to said stopper portion in such a way as to be kept a certain distance apart from said stopper portion toward the outside, said finger grip portion displacing said stopper portion from a locked position, where said stopper portion engages with said end recessed groove, to an unlocked position, where said stopper portion engages with said guide groove, along said regulation groove, and
  a spring member for forcefully urging said base portion toward the center of said lighter body and holding the same attracted at said locked position and said unlocked position, whereby said stopper portion engages with said end recessed groove to prevent pivotal movement of said actuating member when said lock member is situated at said locked position, and said actuating member becomes pivotable when said lock member is displaced to said unlocked position, and also said lock member is displaced to said locked position to the other end of said guide groove as a result of pivotal movement of said actuating member.

2. The safety device for use in a gas lighter as defined in claim 1, wherein said spring member of said lock member is made up of a coiled spring with one end thereof being linked to said base portion and the other end thereof being fixedly fitted to said leg of said actuating member in a curved and deformed fashion.

* * * * *